US009449587B2

(12) United States Patent
Babicz, Sr.

(10) Patent No.: US 9,449,587 B2
(45) Date of Patent: Sep. 20, 2016

(54) STRING SUPPORT DEVICES FOR STRING INSTRUMENTS AND RELATED METHODS

(71) Applicant: Jeffrey T. Babicz, Sr., Newburgh, NY (US)

(72) Inventor: Jeffrey T. Babicz, Sr., Newburgh, NY (US)

( * ) Notice: Subject to any disclaimer, the term of this patent is extended or adjusted under 35 U.S.C. 154(b) by 0 days.

(21) Appl. No.: 14/660,173

(22) Filed: Mar. 17, 2015

(65) Prior Publication Data

US 2015/0279339 A1 Oct. 1, 2015

Related U.S. Application Data

(60) Provisional application No. 61/970,166, filed on Mar. 25, 2014.

(51) Int. Cl.
*G10D 3/04* (2006.01)
*G10D 3/12* (2006.01)

(52) U.S. Cl.
CPC *G10D 3/04* (2013.01); *G10D 3/12* (2013.01); *Y10T 29/49574* (2015.01)

(58) Field of Classification Search
CPC ..... G10D 3/04
See application file for complete search history.

(56) References Cited

U.S. PATENT DOCUMENTS 1,365,839 A * 1/1921 McHugh ..... G10D 3/04 84/307
2,491,991 A * 12/1949 Lundbäck ..... G10D 3/04 84/307
2,714,326 A * 8/1955 McCarty ..... G10D 3/12 84/299
2,740,313 A * 4/1956 McCarty ..... G10D 3/04 84/298
4,069,733 A * 1/1978 Quan ..... G10D 3/12 84/299
4,230,014 A * 10/1980 Hoshino ..... G10D 3/04 84/299
4,291,607 A * 9/1981 Kauffman ..... G10D 3/04 84/299
D265,835 S * 8/1982 Rickard ..... 84/298
4,433,605 A * 2/1984 Matsui ..... G10D 3/12 84/299
4,457,201 A * 7/1984 Storey ..... G10D 3/146 84/267
4,611,523 A * 9/1986 McFarland ..... G10D 3/143 84/267

(Continued)

OTHER PUBLICATIONS

Gibson.com: Gibson USA, Gibson SG Zoot Suit Electric Guitar with "Stopbar" Tailpiece, Printed Jan. 27, 2014, Available online at www2.gibson.com/Products/Electric-Guitars/SG/Gibson-USA/SG-Zoot-Suit.aspx.

(Continued)

*Primary Examiner* — Robert W Horn
(74) *Attorney, Agent, or Firm* — Heslin Rothenberg Farley & Mesiti P.C.; Kristian E. Ziegler

(57) ABSTRACT

The present disclosure provides string support devices for string musical instruments, and in particular locking string support devices and methods of locking string support devices for string musical instruments. In some embodiments the locking string support devices and related methods include a string support member fixed to mounting posts that are coupled to a body of a string musical instrument. In some embodiments the string support devices and related methods include a fixing device that fixes the string support member to each of a plurality of mounting posts. In some embodiments the string support member is fixed to the musical instrument in at least one direction via the mounting posts, such as about a first direction that extends along the length of the musical instrument and/or about a second direction that extends through the of the musical instrument.

14 Claims, 7 Drawing Sheets

(56) References Cited

U.S. PATENT DOCUMENTS

| | | | | |
|---|---|---|---|---|
| 6,613,968 | B1 * | 9/2003 | Devereaux | G10D 3/04 84/298 |
| 6,870,083 | B2 * | 3/2005 | Turner | G10D 3/04 84/298 |
| 7,301,086 | B2 * | 11/2007 | Ito | G10D 3/04 84/298 |
| 7,459,617 | B2 * | 12/2008 | Kim | G10D 3/04 84/298 |
| 7,459,618 | B2 * | 12/2008 | Kim | G10D 3/04 84/298 |
| D643,870 | S * | 8/2011 | Woodland | D17/21 |
| 8,119,893 | B2 * | 2/2012 | Dunwoodie | G10D 3/12 84/312 R |
| 8,723,007 | B2 * | 5/2014 | Tracy | G10D 3/04 84/307 |
| 2003/0230184 | A1 | 12/2003 | Devereaux et al. | |
| 2004/0074367 | A1 * | 4/2004 | Devereaux | G10D 3/12 84/299 |
| 2013/0055876 | A1 * | 3/2013 | Mason | G10D 3/04 84/298 |
| 2014/0174275 | A1 * | 6/2014 | Tanabe | G10D 1/08 84/297 R |
| 2015/0279339 | A1 * | 10/2015 | Babicz, Sr. | G10D 3/04 84/299 |

OTHER PUBLICATIONS

Gibson.com: Gibson USA, Enlarged Photograph of the "Stopbar" Tailpiece of the Gibson SG Zoot Suit Electric Guitar, Printed Jan. 27, 2014, Available online at www.gibson.com/Files/USA/SGs/Zoot-SG/Batched/SGZTRWCH1-Features-Tailpiece.jpg.

* cited by examiner

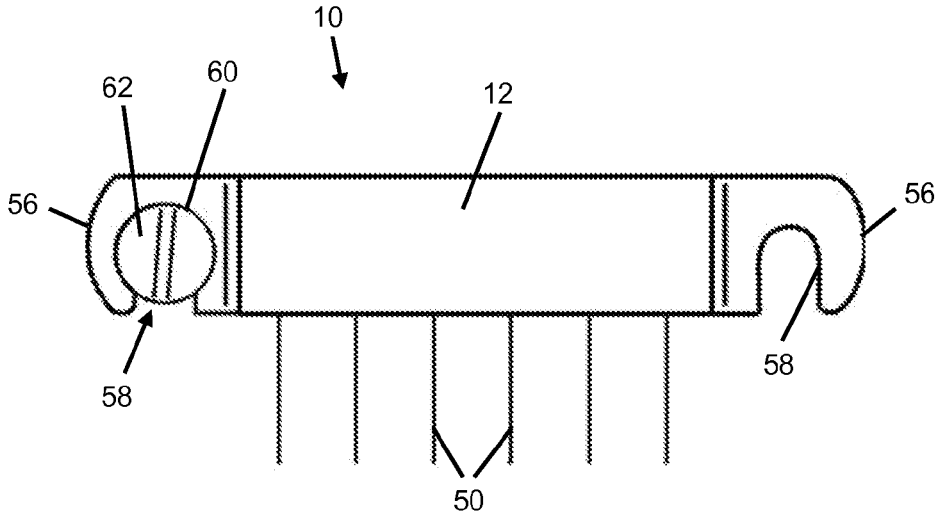
FIGURE 1 – Prior Art
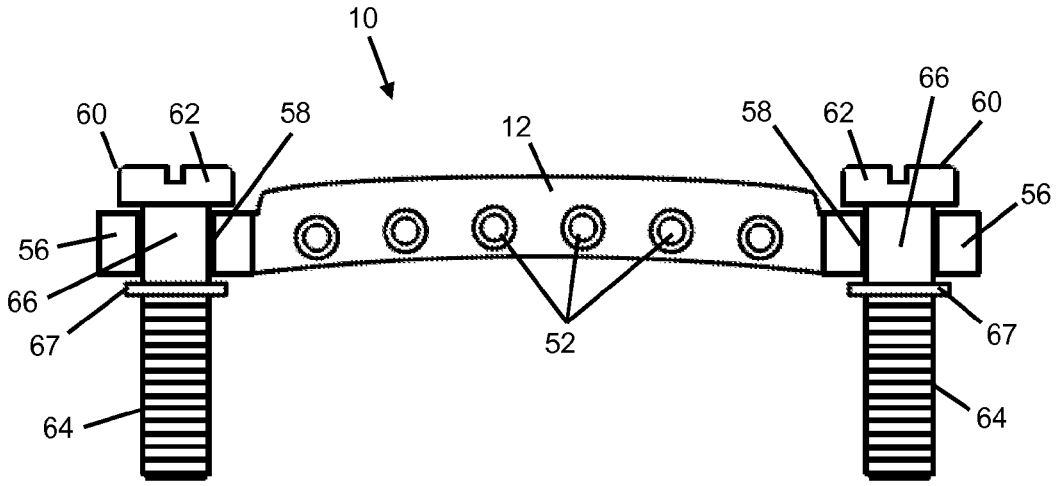
FIGURE 2 – Prior Art

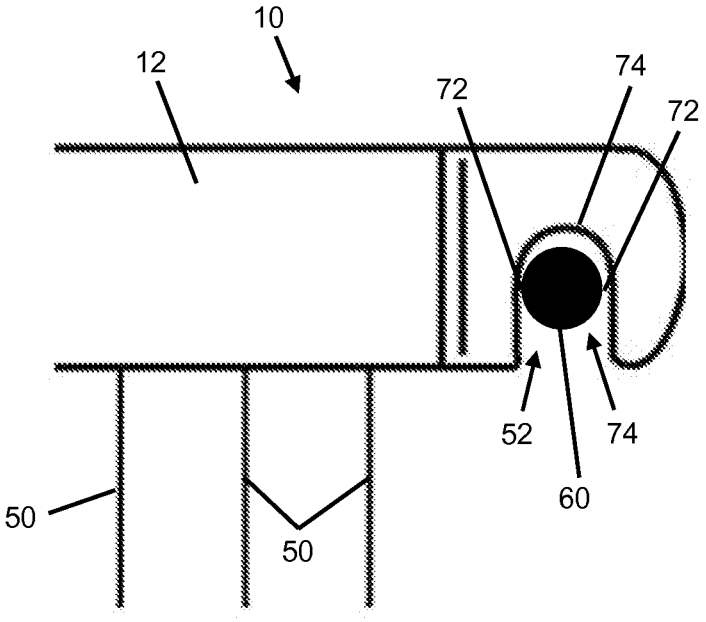
FIGURE 3 – Prior Art
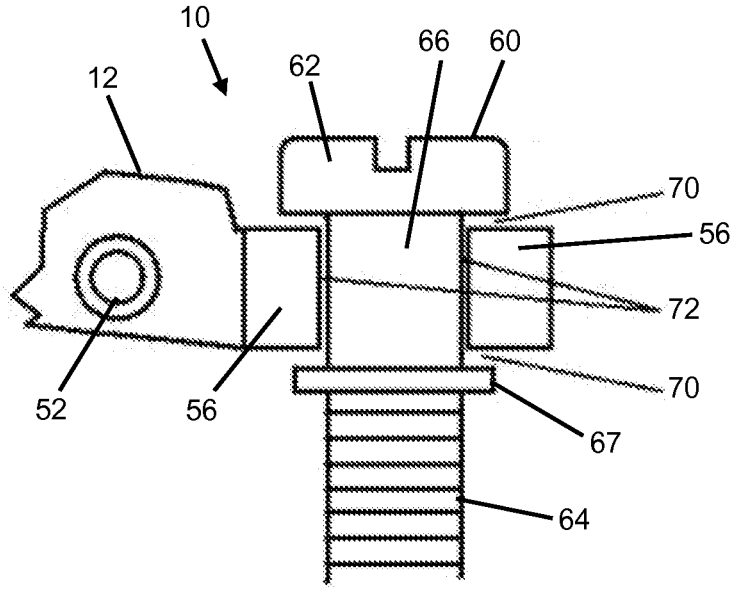
FIGURE 4 – Prior Art

STRING SUPPORT DEVICES FOR STRING INSTRUMENTS AND RELATED METHODS

CROSS-REFERENCE TO RELATED APPLICATION

This application is a non-provisional of U.S. Provisional Patent Application No. 61/970,166, filed on Mar. 25, 2014, and entitled String Support Devices for String Instruments and Related Methods, which is hereby expressively incorporated herein by reference in its entirety.

BACKGROUND

The present disclosure generally relates to string support devices for string musical instruments, and in particular to locking string support devices and methods for string musical instruments.

A typical string support device or mechanism, such as tailpiece or bridge, for a stringed musical instrument or chordophone is merely held in place by string tension. As an example, a common tailpiece of a guitar is at least primarily supported or coupled to the body of the guitar by tension of the strings on the tailpiece and mounting posts passing at least partially through the tailpiece and the body of the guitar. Commonly, the tailpiece is positioned loosely in an unfixed manner on the mounting posts, which are themselves fixed to the body of the guitar. The guitar strings are the passed through the tailpiece but an end of the strings is expanded or otherwise prevented from translating through tailpiece. The guitar strings are then tensioned by tuning pegs at the head or headstock of the guitar. In this way, the tailpiece is held in place by tension forces via the tensioned strings held against or removable coupled to the tailpiece and reactionary forces of the fixed mounting posts. Bridges and other string support mechanisms or devices of stringed musical instruments or chordophones are commonly coupled or held in place on the instrument in a substantially similar manner (i.e., via forces of tensioned strings).

One disadvantage of traditional string support mechanisms/devices for stringed musical instruments or chordophones is that because the string support mechanism/device is held in place or coupled to the instrument via string tension, when the strings are removed or otherwise disengaged from the mechanism/device, the mechanism/device becomes disengaged from the instrument. For example, when strings are removed from an instrument and/or string support mechanism/device, the mechanism/device may disengage from its mounting posts. Once disengaged from the instrument and/or mounting posts, a string support mechanism/device may cause damage to the instrument and/or to the mechanism/device itself. For example, a disengaged mechanism/device may contact the instrument and damage the instrument and/or mechanism/device, damage the mounting posts, fall off the instrument and become damaged, etc. Further, each time the strings are removed from an instrument the string support mechanism/device needs to be reset on the instrument when strings are repositioned on the instrument.

Another disadvantage of traditional string support mechanisms/devices for stringed musical instruments or chordophones is that the string support mechanisms/devices are not fixed to the instrument. Specifically, as discussed above, the string support mechanism/device is held in place or coupled to the instrument via string tension against mounting posts. The connection between the mounting posts and the string support mechanism/device.

As discussed further below, some traditional string support mechanisms/devices allow for movement along a first direction extending along the strings or length of the instrument, and a second direction extending along the mounting posts or through the instrument. In some embodiments, traditional string support mechanisms/devices also allow for movement along a third direction extending across the layout of the strings or the width of the instrument. In this way, as the string support mechanisms/devices are not fixed they allow at least some level of movement of the string support mechanisms/devices, and thereby the strings that they support, with respect to the instrument. The present disclosure recognizes that a loose or non-fixed string support mechanism/device is detriment to musical sustain and tonal performance of the strings.

As a result, a need exists for improved string support mechanisms/devices and related methods for stringed musical instruments that provide locking or fixing of the string support mechanisms/devices to the instrument in at least one direction.

BRIEF DESCRIPTION

In one aspect of the present disclosure, a string support device for a stringed musical instrument is provided by the present disclosure. The stringed musical instrument may define a length and include a body. The string support device may include a plurality of mounting posts, a string support member and a plurality of fixing devices. In some embodiments, the plurality of mounting posts may be elongated along a first direction and configured to be fixed to the body of the musical instrument. In some embodiments, the string support member includes a plurality of string apertures configured to receive musical strings extending therethrough along a second direction. In some embodiments, the string support member may include a mounting aperture on opposing sides of the plurality of string apertures each configured to accept one of the mounting posts extending therethrough along the first direction. In some embodiments, a fixing device is associated with each mounting aperture and mounting post. In some embodiments, each fixing device is configured to fix the string support member along at least one of the first and second directions to the mounting posts.

In another aspect of the present disclosure, a method of fixing a string support member to a stringed musical instrument that defines a length and includes a body is provided by the present disclosure. The method may include obtaining a string support member with a plurality of string apertures configured to receive musical strings extending therethrough along a first direction extending along the length of the musical instrument. In some embodiments the string support member may include a mounting aperture on opposing sides of the plurality of string apertures. In some embodiments the method may include fixing a mounting post through each mounting aperture of the string support member to the body of the musical instrument along the first direction and a second direction extending through the body of the musical instrument. In some embodiments the mounting posts may include a head portion larger than the mounting apertures. The method may also include at least one of: translating a nut threadably coupled to each mounting post along the corresponding mounting post in the first direction to fix the string support member to the musical instrument in the second direction between the head portion of the corresponding mounting post and the corresponding nut; and translating a set screw threadably coupled to the string support member into each mounting aperture along the second direction to bias a corresponding locking slug positioned within each mounting aperture to fix the string support member to the musical instrument in the first direction between the corresponding locking slug and an edge of the corresponding mounting aperture of the string support member.

These and other objects, features and advantages of this disclosure will become apparent from the following detailed description of the various aspects of the disclosure taken in conjunction with the accompanying drawings.

DRAWINGS

FIG. 1 is a top view of an exemplary embodiment of a prior art guitar tailpiece with associated guitar strings;

FIG. 2 is a side view of the exemplary tailpiece of FIG. 2 showing exemplary mounting posts;

FIG. 3 is a top cross-sectional enlarged view of the connection of the exemplary tailpiece and a mounting post of FIG. 2;

FIG. 4 is a side enlarged view of the connection of the exemplary tailpiece and a mounting post of FIG. 2;

DETAILED DESCRIPTION

Figure 5:
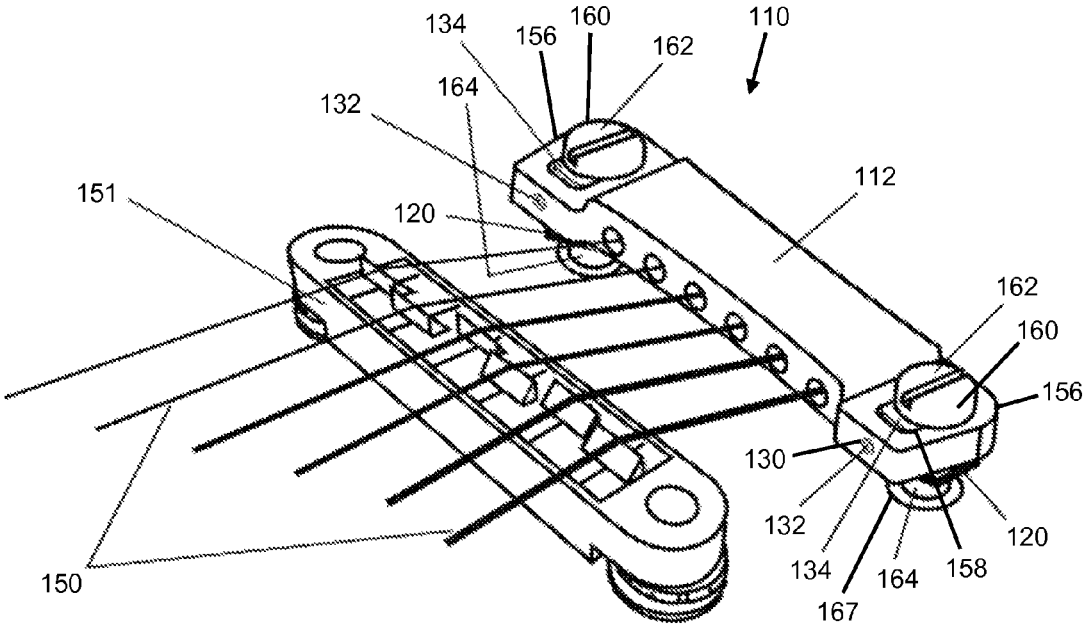
FIG. 5 is a perspective view of an exemplary embodiment of a string support member/device with associated instrument strings according to the present disclosure.

Each embodiment presented below facilitates the explanation of certain aspects of the disclosure, and should not be interpreted as limiting the scope of the disclosure. Moreover, approximating language, as used herein throughout the specification and claims, may be applied to modify any quantitative representation that could permissibly vary without resulting in a change in the basic function to which it is related. Accordingly, a value modified by a term or terms, such as "about," is not limited to the precise value specified. In some instances, the approximating language may correspond to the precision of an instrument for measuring the value. When introducing elements of various embodiments, the articles "a," "an," "the," and "said" are intended to mean that there are one or more of the elements. The terms "comprising," "including," and "having" are intended to be inclusive and mean that there may be additional elements other than the listed elements. As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable. Any examples of operating parameters are not exclusive of other parameters of the disclosed embodiments. Components, aspects, features, configurations, arrangements, uses and the like described, illustrated or otherwise disclosed herein with respect to any particular embodiment may similarly be applied to any other embodiment disclosed herein.

As shown in FIGS. 1-4, a typical string support device or mechanism 10, such as tailpiece or bridge, for a stringed musical instrument or chordophone is supported or coupled to the body of the instrument by tension of strings 50 on the string support device 10 and mounting posts 60 passing at least partially through the tailpiece 10 and into the body of the instrument (not shown). Commonly, the string support device is positioned loosely in an unfixed manner on the mounting posts, which are themselves fixed to the body of the instrument (not shown), as shown in FIGS. 1-4. The instrument strings 50 are the passed through string apertures 52 in the string support device 10), as shown in FIGS. 1-4. An end of the strings 50 is typically expanded or otherwise prevented from translating through string support device 10 (e.g., see FIG. 6). The instrument strings 50 are then tensioned by tuning pegs or another mechanism at the head or headstock of the instrument (not shown). In this way, the string support device 10 is held in place by tension forces via the tensioned strings 50 held against or removable coupled to the string support device 10 acting against the fixed mounting posts 60, as shown in FIGS. 1-4.

As shown in FIGS. 1-4, the mounting posts 60 may include a threaded portion 64, a head portion 62, and a non-threaded shank portion 66 extending between the threaded portion 64 and the head portion 62. The non-threaded shank portion 66 extending between the threaded portion 64 and the head portion 62 may be a thinner or smaller portion of the mounting posts 60 relative to the head portion 62. Further, the non-threaded shank portion 66 may include a wider or larger portion, segment or aspect 67 adjacent the threaded portion 64.

The threaded portion 64 of the mounting posts 60 may be threadably fixed or coupled to the instrument to fix the mounting posts 60 to the instrument. For example, the mounting posts 60 may be fixed to the instrument via the threaded portion 64 in a first direction extending along the direction of the strings or the length of the instrument, a second direction extending through the instrument (such as along an axis of the mounting posts 60), and a third direction extending across at least two of the strings or the width of the instrument. The first and second directions may extend substantially perpendicular to each other. Further, the first, second and third directions may extend substantially perpendicular to each other.

As shown in FIGS. 1 and 4, as the instrument strings 50 "pull" the string support device 10 along the first direction, a typical string support device 10 includes a string support member 12 with hook portion 56 at opposing lateral sides of the string support member 12. Each hook portion 56 typically includes a mounting slot or aperture 58 that is open or accessible from a front side of the string support device 10 in the direction in which the strings "pull" the string support device 10, as shown in FIGS. 1-4. As shown in FIGS. 1 and 4, the back end or side of the slot or aperture 58 is closed along the first direction. Further, the slot or aperture 58 is typically larger than the corresponding portion of a mating mounting posts 60 (e.g., the shank portion 66) in at least the first, second and third directions. In this way, as shown in FIG. 4, the mounting slot or aperture 58 of each hook portion 56 of the string support member 12 of a typical string support device 10 may be slipped or translated over the mounting posts 60 (e.g., the shank portion 66 thereof) along the first direction from the front side to the back side of the string support device 10. The end or back side of the mounting slot or aperture 58 of each hook portion 56 of the string support member 12 of a typical string support device 10 contacts the mounting posts 60 and thereby allows the instrument strings 50 to be tensioned along the first direction. Further, the lateral sides of the mounting slot or aperture 58 of each hook portion 56 of the string support member 12 of a typical string support device 10 contacts the mounting posts 60 and thereby prevent the string support member 12 of the string support device 10 from sliding of the mounting posts 60 in a lateral direction.

As shown in FIGS. 1-4, each hook portion 56 of a string support member 12 of a typical string support device 10 may be mounted or coupled to the shank portion 66 of a corresponding mounting post 60. However, as shown in FIGS. 3 and 4, one disadvantage of traditional string support mechanisms/devices 10 for stringed musical instruments or chordophones is that because the string support member 12 is held in place or coupled to the instrument via string 50 tension acting against the mounting posts 60 and the mounting slot or aperture 58 of each hook portion 56 is sized larger than the corresponding the mounting posts 60, some level of movement may take place between the hook portion 56 of string support mechanism/device 10 and the mounting posts 60. In some embodiments, such as shown in FIGS. 1-4, typical a string support mechanism/device 10 allows movement of the string support member 12 (and thereby the strings 50 supported thereby or thereon) with respect to the mounting posts 60, and therefore the instrument itself, with respect to at least one of the first, second and third directions.

As an example, as shown in FIG. 4, the shank portion 66 of the mounting posts 60 may define a length in the first direction that is smaller than that of each hook portion 56 of the string support member 12 of the string support mechanism/device 10. Stated differently, each hook portion 56 of the string support member 12 may define a length in the first direction that is greater than that of the shank portion 66 of the mounting posts 60 (or other portion to which the string support member 12 is coupled), as shown in FIG. 4. As a result, a gap or space 74 in the first direction may be present between the back edge of the aperture 58 of each hook portion 56 of the string support member 12 of the string support mechanism/device 10 and of the shank portion 66 of the mounting posts 60, as shown in FIG. 4. Further, as also shown in FIG. 4, since the front face or portion of each hook portion 56 of the string support member 12 is open the gap or space 74 is also present on the front side of the mounting posts 60. In this way, when the string support member 12 and a mounting post 60 of a typical string support mechanism/device 10 are coupled or mated with each other, a gap or space 77 in the first direction may be present between the hook portion 56 of the string support member 12 and the mounting posts 60, as shown in FIG. 4. Typical string support mechanism/devices 10 thereby allow movement of the string support member 12 (and thereby the strings 50 supported thereby) along the first direction with respect to the instrument and the components coupled thereto.

As another example, as shown in FIG. 3, the shank portion 66 of the mounting posts 60 may define a length or height in the second direction that is greater than that of each hook portion 56 of the string support member 12 of the string support mechanism/device 10. Stated differently, each hook portion 56 of the string support member 12 may define a length or height in the second direction that is less than that of the shank portion 66 of the mounting posts 60 (or other portion to which the string support member 12 is coupled), as shown in FIGS. 2 and 3. As a result, a gap or space 70 in the second direction may be present between the each hook portion 56 of the string support member 12 of the string support mechanism/device 10 and the ends or boundaries of the shank portion 66 of the mounting posts 60, as shown in FIGS. 3 and 4. Specifically, the length of the shank portion 66 of the mounting posts 60 between the expanded head portion 62 and the expanded portion 67 in the second direction may be relatively larger than that of each hook portion 56 of the string support member 12. In this way, when the string support member 12 and a mounting post 60 of a typical string support mechanism/device 10 are coupled or mated with each other, a gap or space 70 in the second direction may be present between the hook portion 56 of the string support member 12 and at least one of the expanded head portion 62 and the expanded portion 67, as shown in FIGS. 3 and 4. Typical string support mechanism/devices 10 thereby allow movement of the string support member 12 (and thereby the strings 50 supported thereby) along the second direction with respect to the instrument and the components coupled thereto.

As yet another example, as shown in FIGS. 3 and 4, the shank portion 66 of the mounting posts 60 may define a length or width in the third direction that is greater than that of each hook portion 56 of the string support member 12 of the string support mechanism/device 10. Stated differently, each hook portion 56 of the string support member 12 may define a length or width in the second direction that is less than that of the shank portion 66 of the mounting posts 60 (or other portion to which the string support member 12 is coupled), as shown in FIGS. 3 and 4. As a result, a gap or space 72 in the third direction may be present between each hook portion 56 of the string support member 12 of the string support mechanism/device 10 and the lateral ends or boundaries of the shank portion 66 of the mounting posts 60, as shown in FIGS. 3 and 4. In this way, when the string support member 12 and a mounting post 60 of a typical string support mechanism/device 10 are coupled or mated with each other, a gap or space 72 in the third direction may be present between the hook portion 56 of the string support member 12 and each mounting post 60, as shown in FIGS. 3 and 4. Typical string support mechanism/devices 10 thereby allow movement of the string support member 12 (and thereby the strings 50 supported thereby) along the third direction with respect to the instrument and the components coupled thereto.

An exemplary embodiment of a string support mechanism/device according to the present disclosures is shown in FIGS. 5-12 and generally indicated with the reference numeral 110. As notes above, a string support mechanism/device (e.g., string support mechanism/device 110) may be used with a stringed musical instrument to support or coupled the strings to the instrument. In some embodiment, the string support mechanism/device 110 may be a tailpiece or a bridge. Some aspects or elements of exemplary string support mechanism/device 110 may be similar in structure and/or function, at least in part, to the exemplary string support mechanism/device 10 described above, and therefore like reference numerals preceded by the numeral "1" are used to such potential similar aspects or elements.

Figure 6:
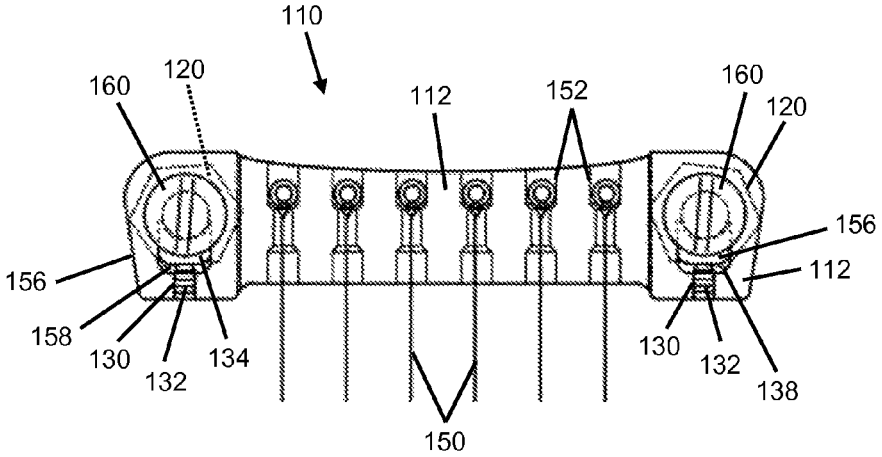
FIG. 6 is a top view of the exemplary string support member/device embodiment of FIG. 5.

As shown in FIGS. 5 and 6 the exemplary string support mechanism/device 110 may couple instrument strings 150 to an instrument (not shown) via one ore more mounting post 160. In some embodiments, the exemplary string support mechanism/device 110 may hold strings 150 adjacent another component of the instrument, such as being a tailpiece adjacent a bridge as shown in FIG. 5. In other embodiments, the support mechanism/device 110 may be a bridge, or another string instrument component configured to at least partially support or otherwise interact with instrument strings.

As shown in FIG. 6, the support member 112 of the exemplary string support mechanism/device 110 may include string apertures 152 extending therethrough. In some embodiments the string apertures 152 may extend in the first direction. As also shown in FIG. 6, each of the strings 150 may pass through a corresponding string aperture 152, and the apertures 152 may be shaped to prevent an expanded portion of the strings 150 from translating through apertures 152. In this way, the strings 150 may be tensioned against the exemplary string support mechanism/device 110.

Figure 7:
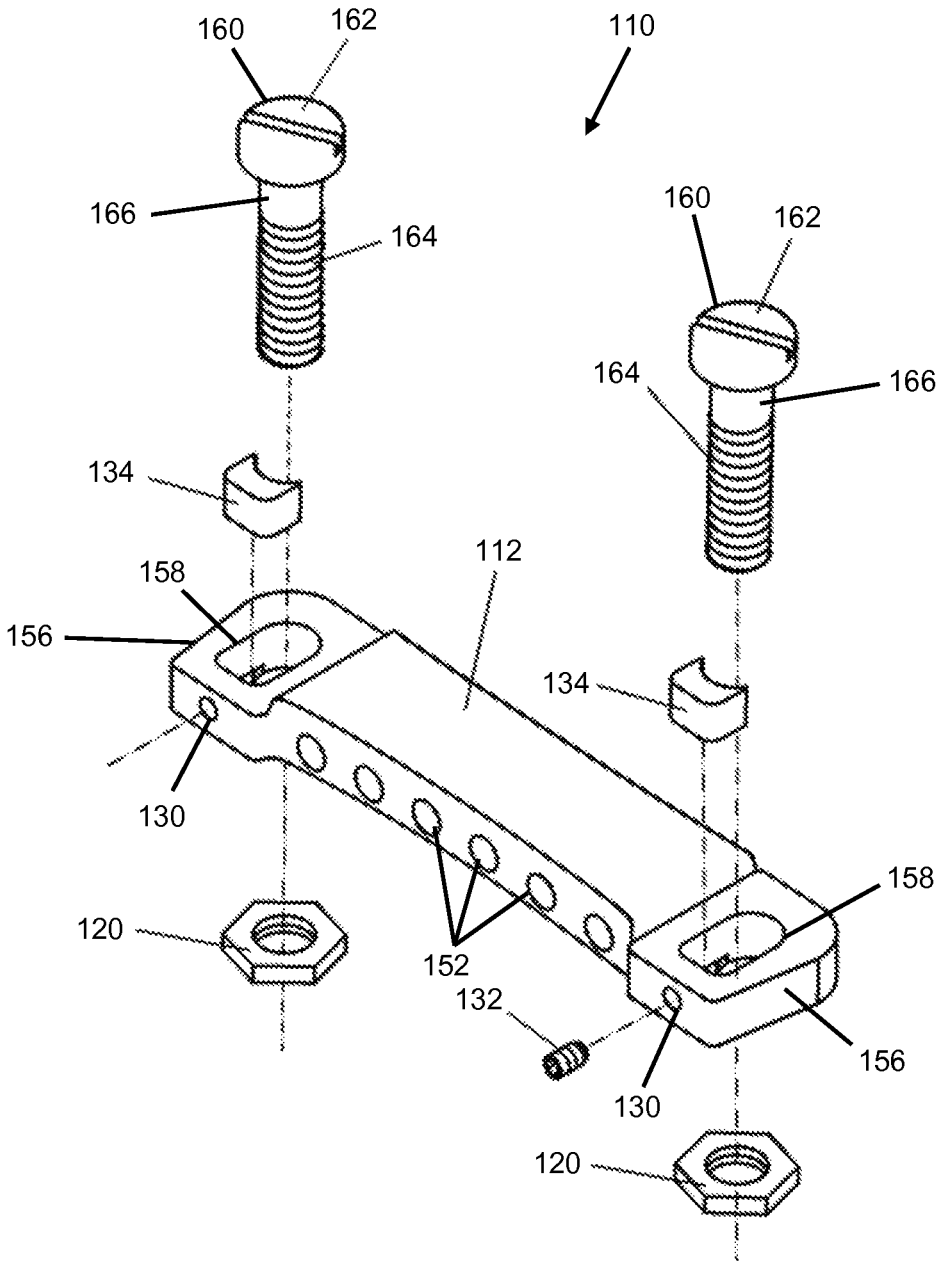
FIG. 7 is a perspective exploded view the exemplary string support member/device embodiment of FIG. 5.
Figure 8:
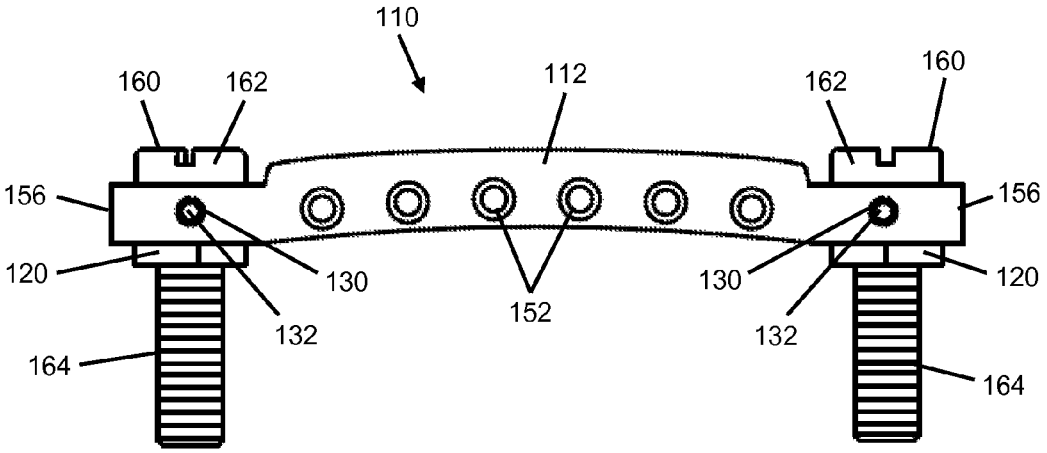
FIG. 8 is a side view of the exemplary string support member/device embodiment of FIG. 5 showing the connection with exemplary mounting posts.
Figure 9:
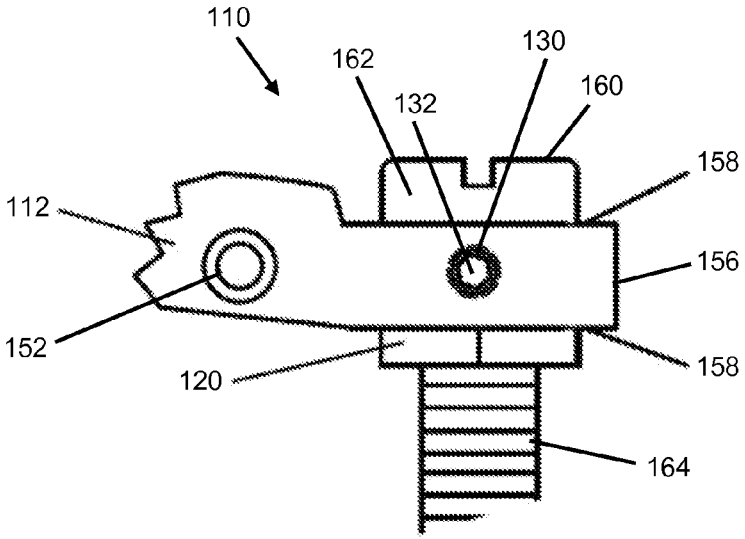
FIG. 9 is an enlarged side view of a portion of the exemplary string support member/device embodiment of FIG. 5 showing a connection with an exemplary mounting post.
Figure 10:
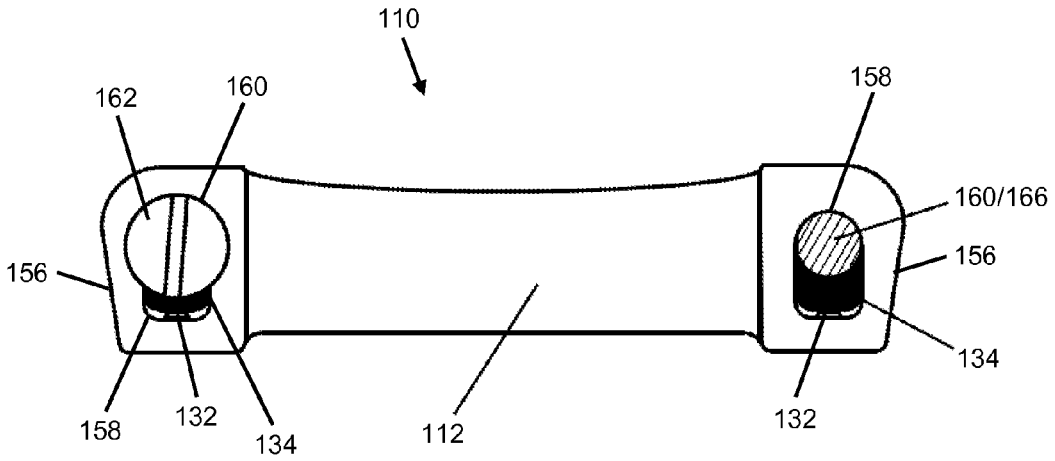
FIG. 10 is a top view of the exemplary string support member/device embodiment of FIG. 5 showing a connection with an exemplary mounting post.
Figure 11:
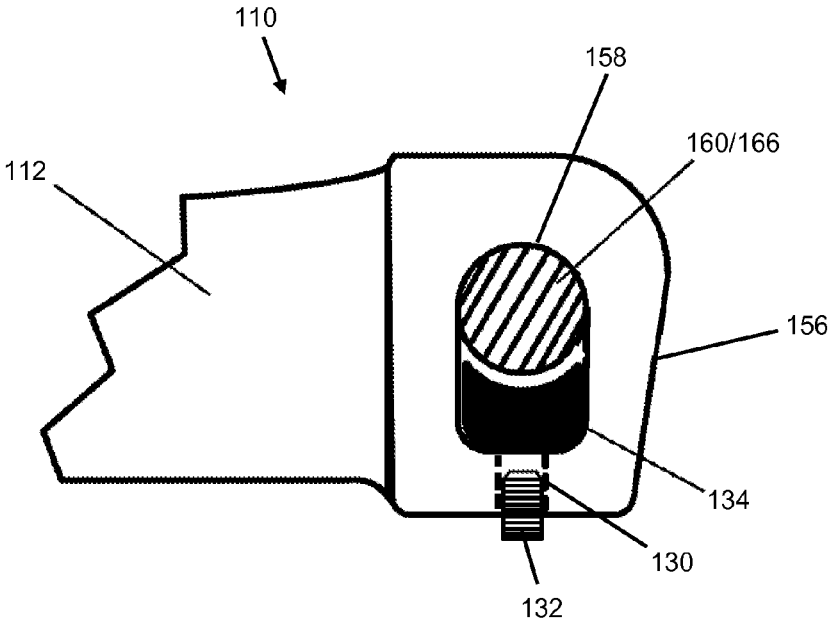
FIG. 11 is a top cross-sectional view of a portion of the exemplary string support member/device embodiment of FIG. 5 showing a connection with an exemplary mounting post in a non-fixed state.
Figure 12:
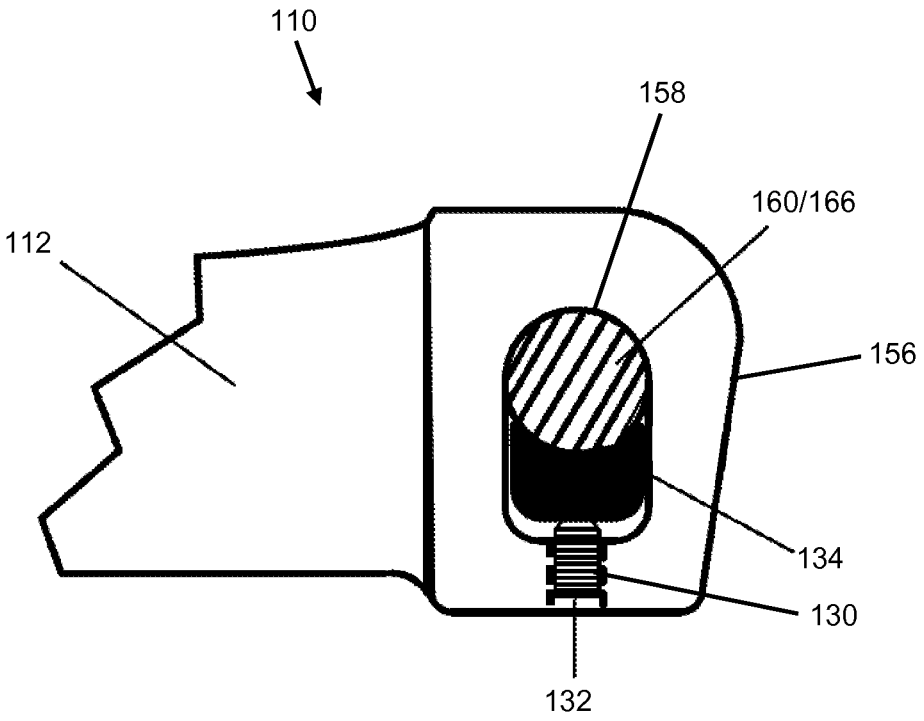
FIG. 12 is a top cross-sectional view of a portion of the exemplary string support member/device embodiment of FIG. 5 showing a connection with an exemplary mounting post in a fixed state.

In some embodiments, the support member 112 of the exemplary string support mechanism/device 110 may include exemplary mounting apertures 158 on opposing lateral sides 156 of the plurality of string apertures 152, as shown in FIGS. 5-12. In some embodiments each exemplary mounting aperture 158 may be configured to accept one of the mounting posts 160 extending therethrough along the second direction, as shown in FIGS. 7-6. Further, in some embodiments each exemplary mounting aperture 158 may be extended in the first direction (the direction in which the strings 150 extend and apply a tension force to the support member 112), as shown in FIGS. 7 and 10-12. In some embodiments each exemplary mounting aperture 158 may fully surround a portion of a corresponding mounting aperture 160 positioned thereon, as shown in FIGS. 10-12. In other exemplary embodiments, the mounting aperture 160 may include at least one opening.

With reference to FIGS. 5-19, in some exemplary embodiments the string support mechanism/device 110 may include the mounting posts 160. As shown in FIGS. 7-9, the mounting posts 160 may include a threaded tip portion 164 at one end, an expanded head portion 162 at another end, and a shank portion 166 extending therebetween. In some exemplary embodiments, the shank portion 166 may be substantially non-threaded. As shown in FIGS. 5 and 8-9, the mounting apertures 160 of the mounting member 112 may be fixedly coupled to the shank portion 166 of the mounting posts 160.

In some exemplary embodiments, the string support mechanism/device 110 may fix the support member 112 (and thereby the strings 150 supported thereby) to the mounting posts 160 at least at least one direction, such as at least along the first direction, the second direction, the third direction, and combinations thereof. In some embodiments, the first direction may extend along the direction of the strings 150 or the length of the instrument. In some embodiments, the second direction may extend along or substantially parallel to an axis defined by the mounting posts 160. In some embodiments, the second direction may extend through the instrument, such as through a body of the instrument. In some embodiments, the third direction may extend laterally across at least two of the strings, between two mounting apertures 158, or the width of the instrument. In some embodiments, the first and second directions may extend substantially perpendicular to each other. In some embodiments, the first, second and third directions may extend substantially perpendicular to each other. In some embodiments, the string support mechanism/device 110 may include a fixing device or mechanism associated with each mounting aperture 158 and corresponding mounting post 160 configured to fix the string support member 112 along at least one of the first, second and third directions (e.g., all of the first, second and third directions) to the mounting posts 160. As the mounting posts may be fixed to an instrument, such as fixed at least in the first, second and third directions, the fixing devices or mechanisms may be configured to fix the string support member 112 along at least one of the first, second and third directions (e.g., all of the first, second and third directions) to the instrument.

For example, as shown in FIGS. 1-9, the string support mechanism/device 110 may include a fixing device including an exemplary threaded nut 120 associated with each mounting post 160. In some embodiments, the exemplary threaded nut 120 may be configured to threadably couple or mate with the threaded portion 164 of the mounting posts 160. For example, the exemplary threaded nut 120 may include internal threads. In some embodiments, the exemplary threaded nut 120 may be sized, shaped or otherwise configured such that the exemplary threaded nut 120 is prevented from passing through a corresponding mounting aperture 158 when threadably coupled with the corresponding mounting post 160. As shown in FIGS. 5-9, the exemplary threaded nut 120 may be positioned on the opposing side of the mounting aperture 158 of the support member 112 in the second direction than the head portion 162 of the mounting posts 160. As such, in some embodiments the mounting aperture 158 may be positioned between the instrument and the support member 112 in the second direction.

In some embodiments, the head portion 162 of each mounting post 160 may be sized, shaped or otherwise configured such that the exemplary head portion 162 is prevented from passing through a corresponding mounting aperture 158 in the second direction when at least the threaded portion 164 extends (or is positioned) through the corresponding mounting post 160, as shown in FIGS. 1-9. In this way, each mounting post 160 may extend through a corresponding mounting aperture 158 in the second direction with the head portion 162 of the mounting posts 160 positioned on the exterior of the support member 122 in the second direction and the threaded nut 120 threadably coupled to the threaded portion 164 of the mounting posts 160 on an interior side of the support member 122 in the second direction, as shown in FIGS. 1-9. Stated differently, each mounting post 160 may extend through a corresponding mounting aperture 158 of the string support member 112 such that the support member 112 is positioned between the nut 120 and head portion 162 of each mounting post 160 in the second direction.

As each threaded nut 120 and head portion 162 of each mounting post 160 is sized, shaped or otherwise configured such that they are prevented from passing through a corresponding mounting aperture 158 in the second direction, the threaded nut 120 and head portion 162 of each mounting post 160 may be utilized to fix the mounting member 112 in the second direction to the mounting posts 160 and, thereby, the instrument. For example, as shown in FIGS. 5-9, each mounting post 160 may be configured such that a threaded nut 120 can be translated along the threaded portion 164 of a corresponding mounting post 160 such that each nut exerts a compression force to the string support member 112 between the corresponding nut 120 and the head 162 of a corresponding mounting post 160 to fix the string support member 112 to the mounting post 160 along the second direction. In this way, the mounting posts 160 may be fixed to an instrument, and the string support member 112 may thereby be fixed to the instrument in the second direction. In some exemplary embodiment, mounting posts 160 may be configured such that the support member 112 is fixed to at least the shank portion 166 of the mounting posts 160 by the threaded nut 120. For example, in some embodiments the threaded portion 164 of the mounting posts 160 may be positioned close enough to the head portion 162 that the nut 120 can be translated along the threaded portion 164 in the second direction to a position such that the head portion 162 and nut 120 abut opposing sides (in the second direction) of the support member 112 about the mounting apertures 158. In some exemplary embodiments, the head portion 162 and nut 120 may exert a compressive force in the second direction to opposing sides of the support member 112.

Another exemplary fixing device or mechanism, or portion of a fixing device or mechanism of the exemplary string support mechanism/device 110 is shown in FIGS. 1-12. In some exemplary embodiments, a fixing device or mechanism of the exemplary string support mechanism/device 110 may be configured to fix the string support member 112 along at least one of the first and third directions to the mounting posts 160, and thereby the instrument, as shown in FIGS. 1-12. With reference to FIGS. 6 and 12, in some embodiments the support member 112 of the exemplary string support mechanism/device 110 may include an exemplary threaded aperture 130 associated with each mounting aperture 158. In some embodiments, each threaded aperture 130 may include internal threads.

In some exemplary embodiments, each threaded aperture 130 may extend from an exterior surface of the string support member 112 and into each mounting aperture 158, as shown in FIGS. 11 and 12. In some such exemplary embodiments, each threaded aperture 130 may extend at least partially along the first direction, as shown in FIGS. 11 and 12. In some embodiments, each threaded aperture 130 may extend substantially along the first direction, as shown in FIGS. 11 and 12. In some other embodiments, however, each threaded aperture 130 may not extend at least partially along the first direction.

In some embodiments, the exemplary string support mechanism/device 110 may include a threaded set member 132, such as a set screw, associated with each threaded aperture 130, as shown in FIGS. 5-12. In some embodiments, each set member 132 may include external threads. In some embodiments, each threaded set member 132 and a corresponding threaded aperture 130 of the string member 112 may be configured to threadably couple or mate with each other such that the set member 1232 is capable of translating along the threaded aperture 130 via rotation thereof. In some embodiments, the set member 132 may include a mechanism configured to engage a tool that rotates the set member 132.

In some exemplary embodiments, as shown in FIGS. 5-7 and 10-12, exemplary string support mechanism/device 110 may include a locking slug 134 associated with a corresponding mounting aperture 158 and mounting post 160. Each locking slug 134 may be positioned or arranged within a corresponding mounting aperture 158 between the front edge of the mounting aperture 158 and the corresponding mounting post 160 extending through the mounting aperture 158 in the first direction as shown in FIGS. 5-7 and 10-12. In some alternative embodiments, each locking slug 134 may be positioned or arranged within a corresponding mounting aperture 158 between the back edge of the mounting aperture 158 and the corresponding mounting post 160 extending through the mounting aperture 158 in the first direction. Still further, in some alternative embodiments each locking slug 134 may be positioned or arranged within a corresponding mounting aperture 158 between a lateral side edge of the mounting aperture 158 and the corresponding mounting post 160 extending through the mounting aperture 158.

As shown in FIGS. 7 and 10-12, in some embodiments the portion or surface of the exemplary locking slug 134 adjacent or proximate the corresponding mounting post 160 may be configured to mate against the mounting post 160. For example, the portion or surface of the exemplary locking slug 134 adjacent or proximate the corresponding mounting post 160 may include a shape, size and/or configuration that mimics or mirrors the corresponding shape, size and/or configuration of the mounting post 160 in the first direction. In some embodiments, the mounting posts 160 may be cylindrical, and the portion or surface of the exemplary locking slug 134 adjacent or proximate the corresponding mounting post 160 may be convex to abut or engage a portion of the cylindrical mounting post 160, as shown in FIGS. 7 and 10-12.

In some exemplary embodiments, as shown in FIGS. 11 and 12, each set member 132 and corresponding threaded aperture 130 may be configured such that rotation of each set member 132 translates the set member 132 at least partially in the first direction. With reference to FIGS. 5, 6 and 10-11, in some exemplary embodiments each locking slug 134 is positioned within a corresponding mounting aperture 158 between a corresponding set member 132 and a corresponding mounting post 160 in the first direction. In this way, in some embodiments each mounting post 160 is fixed between a back edge of a corresponding mounting aperture 158 in the first direction and a corresponding locking slug 134 to fix the string support member 112 to the mounting posts 160 (and thereby the instrument) along the first direction.

As shown in FIGS. 11 and 12, the string support mechanism/device 110 may be configured such that rotation of each set member 132 translates each set member 132 along the correspond aperture 130 at least partially in the second direction with respect to the support member 112 until it engages the corresponding locking slug 134. Further rotation and translation of each set member 132 thereby translates the corresponding locking slug 134 in the second direction until it engages a portion of the corresponding mounting post 160 (e.g., the shank portion 166 of the mounting post 160). Still further rotation of each set member 132 causes the corresponding locking slug 134 to exert a force against the corresponding mounting post 160 and, eventually, exert a compressive force in the first direction to opposing sides of the mounting post 160 by the locking slug 134 and the back side or edge of the corresponding mounting aperture 158. In this way, in some embodiments the fixing device or mechanism of the support mechanism/device 110 may exert a clamping or compressive force to the mounting posts 160 to fix the support member 112 to the mounting posts 160 (and thereby the instrument) in the first direction. Such compressive force may also fix the support member 112 to the mounting posts 160 (and thereby the instrument) in the third direction.

In some embodiments, each locking slug 134 may be configured to abut or mate with a side or portion of a corresponding mounting post 160 that faces, at least partially, along the third direction. In some such embodiments each locking slug 134 may be configured to fix the support member 112 to the corresponding mounting posts 160 (and thereby the instrument) in the third direction. In some embodiments, as shown in FIGS. 10-12, each mounting aperture 158 may be configured to abut or mate with one or more sides or portions of a corresponding mounting post 160 that face, at least partially, along the third direction. In some such embodiments, as shown in FIGS. 10-12, each mounting aperture 158 may be configured to fix the support member 112 to the corresponding mounting posts 160 (and thereby the instrument) in the third direction. In some embodiments, a compressive force exerted by a locking slug 134 and an edge or side of a corresponding mounting aperture 158 may fix the support member 112 to the mounting post 160 (and thereby the instrument) in the third direction.

It is to be understood that the above description is intended to be illustrative, and not restrictive. Numerous changes and modifications may be made herein by one of ordinary skill in the art without departing from the general spirit and scope of the invention as defined by the following claims and the equivalents thereof. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Also, the term "operably" in conjunction with terms such as coupled, connected, joined, sealed or the like is used herein to refer to both connections resulting from separate, distinct components being directly or indirectly coupled and components being integrally formed (i.e., one-piece, integral or monolithic). Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure. It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the disclosure may include only some of the described embodiments. Accordingly, the invention is not to be seen as limited by the foregoing description, but is only limited by the scope of the appended claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

I claim:

1. A string support assembly for a body of a stringed musical instrument, comprising:

a plurality of mounting posts being elongated along a first direction and each including a threaded portion for affixing to the body of the musical instrument, a head portion, and a non-threaded shank portion extending between the threaded portion and the head portion, a string support member with a plurality of string apertures sized to receive musical strings extending therethrough along a second direction and to prevent a bulbous end of the musical strings from passing therethrough, the string support member including a mounting aperture on opposing sides of the plurality of string apertures sized and shaped to accept one of the mounting posts extending therethrough along the first direction and sized larger than at least the non-threaded shank portion of each mounting post along the second direction, wherein the string support member includes threaded apertures extending from an exterior surface of the string support member to each mounting aperture; and a fixing device associated with each mounting aperture and mounting post including a set screw threadably coupled with the threaded aperture of a corresponding mounting aperture, and a locking slug within the mounting apertures positioned between the corresponding set screw and the corresponding mounting post in the second direction, wherein each set screw and threaded aperture are configured such that rotation of each set screw translates the set screws along the second direction to fix the string support member along the first and second directions to at least the non-threaded shank portions of the mounting posts.

2. The string support assembly of claim 1, wherein the string support member is a tailpiece or a bridge.

3. The string support assembly of claim 1, wherein the first direction extends through the body of the musical instrument when the mounting posts are fixed to the body of the musical instrument via the treaded portion, and wherein the second direction extends along a neck of the musical instrument.

4. The string support assembly of claim 3, wherein the first and second directions are oriented at about 90 degrees from each other.

5. The string support assembly of claim 1, wherein each mounting post is fixed between an edge of a corresponding mounting aperture and a corresponding locking slug such that the string support member is fixed to the mounting posts along the second direction.

6. The string support assembly of claim 5, wherein rotation of each set screw exerts a force to the corresponding locking slug to translate the corresponding locking slug along the second direction and against the corresponding mounting post.

7. The string support assembly of claim 1, wherein each mounting aperture of the string support member is sized smaller than the head portion of the mounting along in the first direction to prevent the mounting posts from passing through the string support member in the first direction.

8. The string support assembly of claim 7, wherein the fixing devices include a threaded nut threadably coupled to the threaded portion of each mounting post, and wherein the string support member is positioned between the nut and head portion of each mounting post in the first direction.

9. The string support assembly of claim 8, wherein the nut and head portion of each mounting post fix the string support member to the mounting posts along the first direction.

10. The string support assembly of claim 9, wherein rotation of each nut exerts a compression force to the string support member between the corresponding nut and the head of a corresponding mounting post to fix the string support member to the mounting posts along the first direction.

11. A method of fixing a string support member to a body of a stringed musical instrument, comprising:

obtaining a string support member with a plurality of string apertures sized to receive musical strings extending therethrough along a first direction and to prevent a bulbous end of the musical strings from passing therethrough, the string support member including a mounting aperture on opposing sides of the plurality of string apertures;

fixing a mounting post through each mounting aperture of the string support member to the body of the musical instrument along the first direction and a second direction extending through the body of the musical instrument, the mounting posts including a head portion larger than the mounting apertures;

translating a nut threadably coupled to each mounting post along the corresponding mounting post in the first direction to fix the string support member to the musical instrument in the second direction between the head portion of the corresponding mounting post and the corresponding nut; and translating a set screw threadably coupled to the string support member into each mounting aperture along the second direction to bias a corresponding locking slug positioned within each mounting aperture to fix the string support member to the musical instrument in the first direction between the corresponding locking slug and an edge of the corresponding mounting aperture of the string support member.

12. The method of claim 11, wherein fixing a mounting post through each mounting aperture of the string support member to the body of the musical instrument further includes threadably coupling the threaded portion of each mounting post with a corresponding nut after passing the threaded portion of the mounting posts through the mounting aperture of the string support member and before threadably coupling the threaded portion to the body of the musical instrument, and wherein string support member is fixed at least to the non-threaded shank portions of the mounting posts.

13. A method of fixing a string support member to a body of a stringed musical instrument, comprising:

obtaining a string support member with a plurality of string apertures sized to receive musical strings extending therethrough along a first direction and to prevent a bulbous end of the musical strings from passing therethrough, the string support member including a mounting aperture on opposing sides of the plurality of string apertures;

fixing a mounting post through each mounting aperture of the string support member to the body of the musical instrument along the first direction and a second direction extending through the body of the musical instrument, the mounting posts including a head portion larger than the mounting apertures; and at least one of:

translating a nut threadably coupled to each mounting post along the corresponding mounting post in the first direction to fix the string support member to the musical instrument in the second direction between the head portion of the corresponding mounting post and the corresponding nut; and translating a set screw threadably coupled to the string support member into each mounting aperture along the second direction to bias a corresponding locking slug positioned within each mounting aperture to fix the string support member to the musical instrument in the first direction between the corresponding locking slug and an edge of the corresponding mounting aperture of the string support member, and wherein the mounting posts include a threaded portion and a non-threaded shank portion extending between the threaded portion and the head portion, and wherein fixing a mounting post through each mounting aperture of the string support member to the body of the musical instrument includes translating the threaded portion of the mounting posts through a corresponding mounting aperture of the string support member and threadably coupling the threaded portion to the body of the musical instrument.

14. The method of claim 13, wherein fixing a mounting post through each mounting aperture of the string support member to the body of the musical instrument further includes threadably coupling the threaded portion of each mounting post with a corresponding nut after passing the threaded portion of the mounting posts through the mounting aperture of the string support member and before threadably coupling the threaded portion to the body of the musical instrument, and wherein string support member is fixed at least to the non-threaded shank portions of the mounting posts.

* * * * *